United States Patent [19]

Green

[11] Patent Number: 4,657,598

[45] Date of Patent: Apr. 14, 1987

[54] REJUVENATING NEWSPAPER FILM PROCESS

[75] Inventor: Kendell L. Green, Odessa, Tex.

[73] Assignee: The Odessa American, a subsidary of Freedom Newspapers, Inc., Odessa, Tex.

[21] Appl. No.: 757,066

[22] Filed: Jul. 19, 1985

Related U.S. Application Data

[63] Continuation-in-part of Ser. No. 496,947, May 23, 1983, abandoned.

[51] Int. Cl.[4] ..... B08B 1/02; B08B 1/04; B08B 5/02; B08B 5/04

[52] U.S. Cl. ..... 134/9; 15/100; 15/306 A; 15/308; 134/21; 134/37; 355/15

[58] Field of Search ..... 134/9, 21, 37; 355/15; 15/100, 306 A, 308; 29/90.5

[56] References Cited

U.S. PATENT DOCUMENTS

| | | | |
|---|---|---|---|
| 3,050,758 | 8/1962 | Wilkins | 15/100 |
| 3,099,856 | 8/1963 | Eichorn et al. | 355/15 |
| 3,193,410 | 7/1965 | Forrest et al. | 15/100 |
| 3,195,023 | 3/1965 | Sadamitsu . | |
| 3,510,903 | 5/1970 | Stoever et al. | 355/15 |
| 3,534,427 | 10/1970 | Severgnse | 15/301 |
| 3,546,733 | 12/1970 | Johnson | 15/308 |
| 3,598,487 | 8/1971 | Mizuguchi et al. | 355/15 |
| 3,630,776 | 12/1971 | Barr | 355/15 |
| 3,641,605 | 2/1972 | Lindsey | 15/1.5 R |
| 3,685,485 | 8/1972 | Kutsuwada et al. | 355/15 |
| 3,694,071 | 9/1972 | Touchette | 15/100 |
| 4,063,324 | 12/1977 | Junge | 15/100 |
| 4,326,315 | 4/1982 | Miles et al. | 355/15 |

*Primary Examiner*—Richard V. Fisher
*Assistant Examiner*—W. Gary Jones
*Attorney, Agent, or Firm*—Marcus L. Bates

[57] ABSTRACT

A process for rejuvenating used pyrofax photostatic film to enable the film to be used another time. The film is in the form of an elongated plastic web and has an image side opposed to a back side. The indica formed on the image side of the web is removed, thereby enabling the web to be reused another time in the newspaper printing process, for example. The process of the present invention comprises moving the web respective to a rotating cylindrical cloth apparatus so that the cloth apparatus gently wipes the indica from the image side of the web. Air blast and suction means facilitate translocation of the removed indicia from proximity of the rotating cylindrical cloth.

3 Claims, 8 Drawing Figures

REJUVENATING NEWSPAPER FILM PROCESS

BACKGROUND OF THE INVENTION

Many modern newspaper factories employ pyrofax photostatic film during the printing process. The film, often referred to hereinafter as a web, is in the form of an elongated thin member having a plastic image side and an opposed metallic back side. The web is about one and one-half feet wide and several hundred feet long so that it can be conveniently wound up on a central core into the form of a cylinder to facilitate the handling and storage thereof. One cylindrical roll of the web material contains sufficient material to enable the average size newspaper plant to print newspapers for several days. The film is marketed by the 3M Company of Minnesota and is sometimes referred to as Pyrofax Photostatic Film.

In printing newspapers, a master copy representative of a newspaper page is transferred onto the image side of the web, and thereafter the image is transferred from the web onto a transmat, and thereafter onto aluminum printing plates by a thermo process, thereby enabling the newspaper printing press to print the newspaper. Accordingly, the width of the web is approximately the width of a page of the printed newspaper.

After the image or indicia contained on the image side of the web has been transferred onto the transmat, the web is stored in a rolled up cylindrical configuration, usually upon one of the old used cores. Conventionally, the image side of the web is located to form the inner surface of the cylindrical roll of used web material.

It is known to remove the indicia from the image side of the web, as evidenced by Miles, et al U.S. Pat. No. 4,326,315. In the Miles, et al patent, a plurality of spaced parallel bunny brushes rotate about the central axis thereof, and are brought to bear against the image side of the traveling web. A considerable leading and trailing end of the web is sacrificed each time the web is reprocessed, with the loss of the leading and trailing marginal ends of the web being proportional to the length of the processing equipment, which is considerable and may amount to as much as 10–15 feet. Moreover, in the Miles et al process, the web can be reprocessed or rejuvenated only a limited number of times because the delicate image side of the web is harmed each time the web passes through the guide rollers and bunny brush assembly of the Miles, et al process equipment.

In the past, it has been proposed to clean dust and foreign objects from a film strip by utilizing vacuum, an elongated wiping cloth, and means for removing static electrical charges from the surface of the strip, as exemplified by Lindsay, U.S. Pat. No. 3,641,605. In the Lindsay patent, it is not contemplated to remove the indicia from a web, but rather it is contemplated to remove the unwanted foreign material from newly manufactured film so that the film is made available in clean, sterile condition.

Others have proposed engaging an elongated web, or a cylindrical drum, in order to remove indicia from the surface thereof as evidenced by the following patents:

| | | | |
|---|---|---|---|
| Klett | 4,230,406 | Eichorn, deceased | 3,893,416 |
| Severynse | 3,534,427 | Martino | 4,148,576 |

-continued

| | | | |
|---|---|---|---|
| Sadamitsu | 3,795,025 | Taylor | 3,706,108 |

However, none of these references suggest that an elongate web of pyrofax photostatic film be rejuvenated according to the method and apparatus of the present invention.

The present invention differs from the above prior art both mechanically and conceptionally. In the present invention the image side of the web is forced to travel circumferentially a limited distance about the outer peripheral surface of a rotating cylindrical wiping cloth. The cylindrical wiping cloth engages the web while at the same time it revolves at a speed to provide a gentle wiping action and thereby completely clean the entire image surface of the web, whereupon the rejuvenated web can then be reused many more times in the newspaper printing plant by repeating the rejuvenating process set forth herein.

SUMMARY OF THE INVENTION

The present invention comprehends both method and apparatus by which an elongate web of pyrofax photostatic film, such as used in a newspaper printing process, for example, is rejuventated in a manner which enables the web to be reused a plurality of times. The process of the present invention comprehends removing the means forming the indicia from the image side of the web by arranging the web to move along its length from a loading station to a processed station. This step of the process, according to the present invention, is preferably carried out by mounting a cylindrical roll of the used web material at the loading station, mounting a web receiving cylinder at the processed station, and extending the used web longitudinally along its length from one to the other station.

The web receiving cylinder is rotated about its central axis to cause the used web material to unwind from the used cylinder and for rejuvenated or processed web material to be stored in wound-up configuration onto the processed cylinder. Brake means associated with the used web cylinder maintains an optimum tension on the marginal length of the web located between the two stations.

The back side of the web is opposed to the image side of the web which is engaged at a location between the loading and processing stations by spaced guide means. The spaced guide means urges the marginal length of the image side of the web to be forced into contact with the outer surface of a rotating cylindrical wiping cloth.

The cylindrical wiping cloth preferably is in the form or an elongated piece of gauze or cheese cloth wound about the outer peripheral surface of a cylinder to thereby provide a soft cylindrical wiping cloth having an unusually suitable texture for engaging and removing the indicia from the image side of the web. The cylindrical wiping cloth rotates about its central longitudinal axis to thereby continually bring the outer peripheral surface of the gauze-like cloth material into intimate wiping contact with respect to the traveling image side of the web. The longitudinal axis of the cylindrical wiping cloth and the longitudinal axis of the two spaced guide means are aligned respective to one another to cause the image side of the web to be urged against a marginal circumferentially extending surface area of the cylindrical cloth, thereby forcing the web to travel circumferentially a limited peripheral distance about the outer surface of the cylindrical wiping cloth.

An air nozzle is arranged to force the particles of removed indicia towards the traveling opposed edge portions of the web, where a suction means ingests the removed particles and translocates the particles to a suitable disposal area.

In the preferred form of the invention, the equipment necessary for carrying out the process is exceedingly compact and requires a single cylindrical wiping cloth. Accordingly, no significant amount of material is lost at each opposed marginal end of the web for the reason that all but the last and first foot or so of the web material receives the benefits of the rejuvenating process, and since the length of the lead and tail entering and leaving the camera is about equivalent to the opposed marginal ends of the web which is initially and finally unprocessed, the present novel process recovers substantially 100% of the usable web material. Moreover, the action of the cylindrical wiping cloth in removing indicia from the image side of the film is unexpectedly gentle and thereby has the unexpected additional advantage of not injuring the sensitive and delicate film material. Furthermore, the limited number of guide means required along with the single image removing means associated with the apparatus enables the alignment of the web to be accurately maintained, thereby avoiding any creasing or undue bending of the web as it travels from the used to the processed cylinders. These unexpected advantages realized with the present invention enable a web to be reused an astonishing number of times as compared to other known processes for rejuvenating web material.

Accordingly, the present invention provides the advantage of a minumum loss of material at the head and tail marginal ends of the web, enables the web to be used substantially more times as found in the prior art processes, is simple in design, and can easily be incorporated into a newspaper plant, thereby obviating the necessity of shipping the rolled-up film to distant points for processing, all of which amount to unexpected savings in operating costs.

Accordingly, a primary object of the present invention is the provision of method and apparatus for rejuvenating elongated webs of photostatic film material in a manner which enables the web to be reprocessed a plurality of times.

Another object of the present invention is the provision of apparatus for rejuvenating used webs of pyrofax photostatic film by moving the web along its longitudinal length from a loading to a processed station, engaging a marginal length of the web at a location between the stations with a cylindrical wiping cloth, rotating the wiping cloth at a peripheral velocity which removes the means forming the indicia from the image side thereof, thereby rendering the image side of the web suitable for reuse.

A further object of the present invention is the provision of apparatus by which a cylinder of rolled up film material is unrolled, treated by engagement with a rotating wiping cloth, re-rolled onto another cylinder, thereby enabling the film material to be reused.

Another and still further object of the present invention is the provision of apparatus for wiping indicia from the image side of an elongated web of film in a manner which renders the film reusable another time.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENTS

Figure 1:
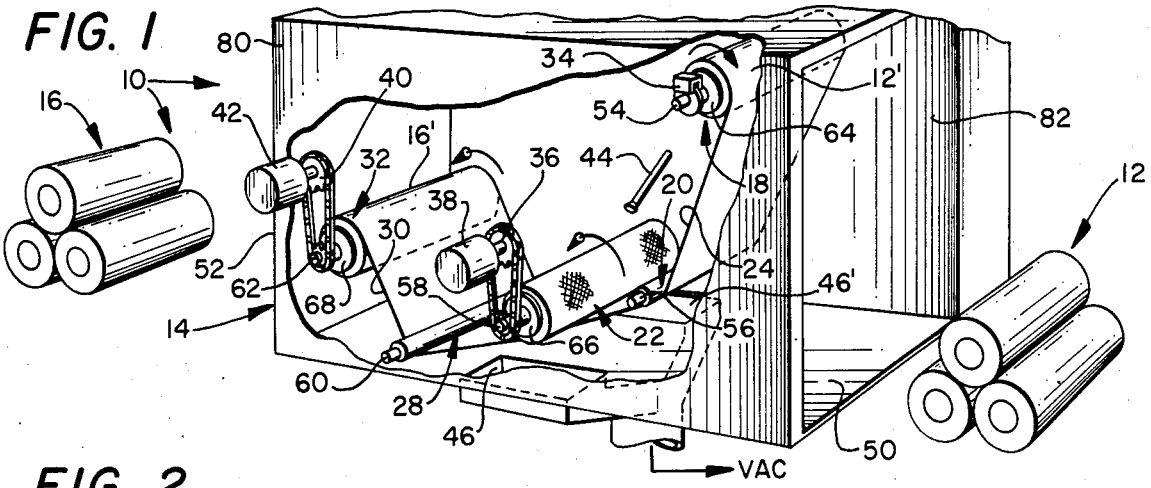
FIG. 1 is a fragmentary, perspective, side view of apparatus made in accordance with the present invention, with some parts being cut away therefrom, and some parts being shown in phantom.

FIG. 1 discloses a process 10 according to the present invention. The process 10 can be carried out by the use of apparatus 14 by which used film at 12, in the form of a rolled up, elongated plastic web, can be rejuvenated to provide the processed film at 16. The processed film 16 can be reused, such as for example, in a newspaper printing process, or other known commercial printing applications.

The apparatus 14 of the present invention includes the illustrated enclosure, which can take on any number of different forms, and preferably is in the form of a rectangular box of metallic or plastic construction within which there is suitably journaled a feed roller 18, an idler roller 20, a cylindrical cloth roller 22, hereinafter referred to as a tabby roller, a second idler roller 28, and a take up roller 32.

Figure 2:
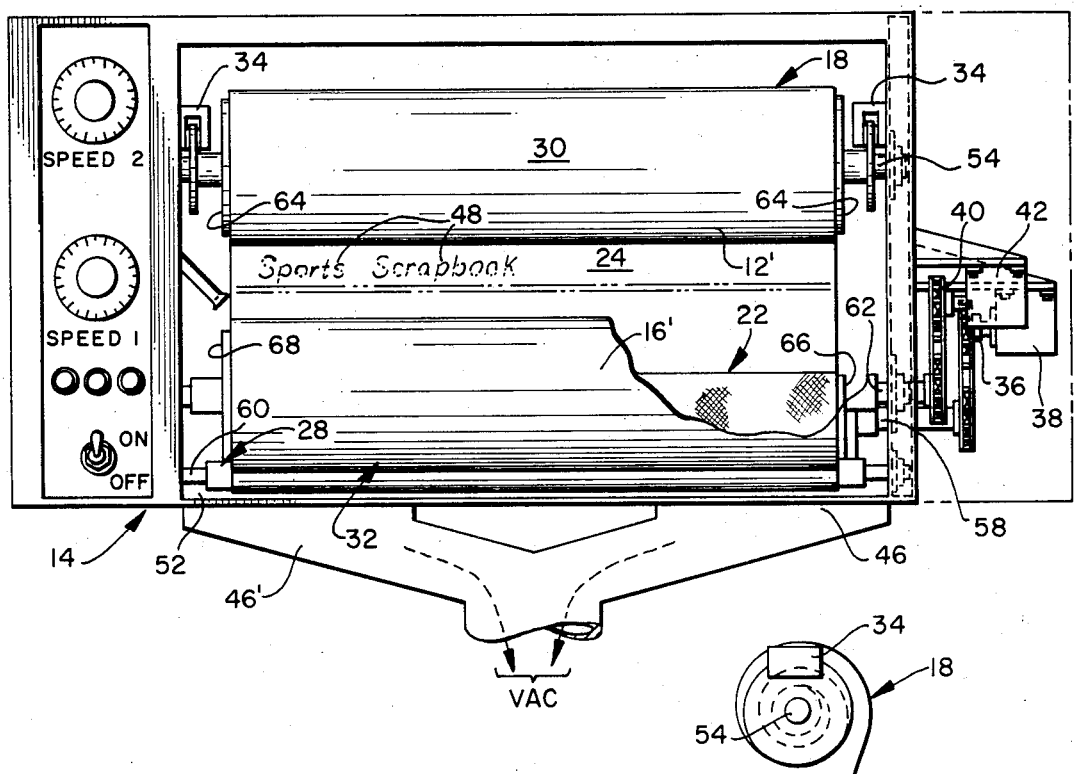
FIG. 2 is an end view of the apparatus disclosed in FIG. 1, with some parts being broken away therefrom, so as to reveal additional details thereof.

As seen in FIGS. 1 and 2, the feed roller 18 receives a cylinder of rolled-up pyrofax photostatic film in the form of an elongated web, usually several hundred feet in length, and usually about 1-½ feet in width. The web has an image side 24 and an obverse or opposite side 30.

Figure 3:
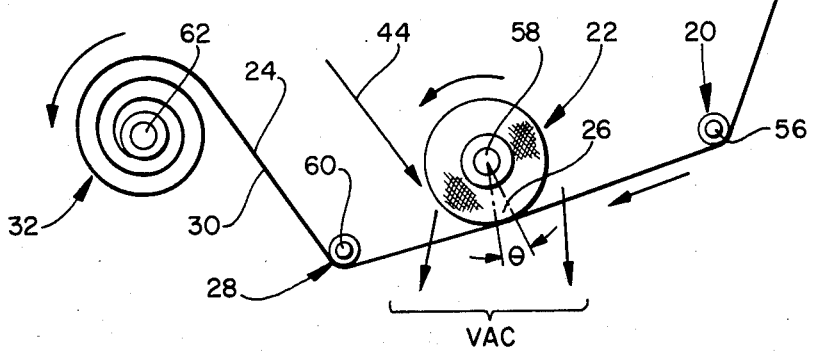
FIG. 3 is a part diagrammatical, part schematical, representation of a method carried out in accordance with the present invention.

The tabby roller 22 and the first and second idler rollers, 20 and 28, are arranged respective to one another whereby the web curves about a segment formed by a limited outer peripheral surface area of the tabby roller, as noted by numeral 26 in FIG. 3.

Figure 6:
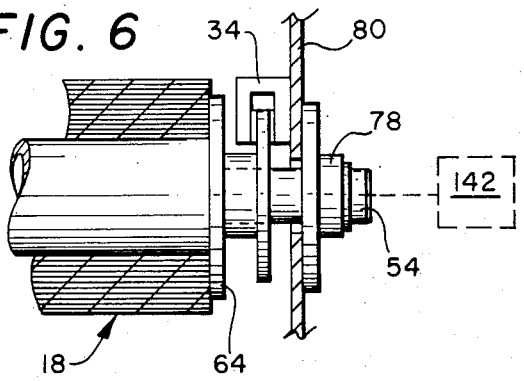
FIG. 6 is an enlarged, fragmentary, part cross-sectional view of part of the apparatus disclosed in FIG. 1.

As best seen illustrated in FIGS. 1, 2, and 6, the feed roller includes a drag brake 34, which can take on any number of different forms, but preferably is an adjustable friction brake, the details of which will be more fully described later on in this disclosure. As seen in FIGS. 1 and 2, the tabby roller is driven by the illustrated chain and sprocket drive system, and includes drive sprocket 36 which is driven by a gear reduction apparatus 38.

Figure 4:
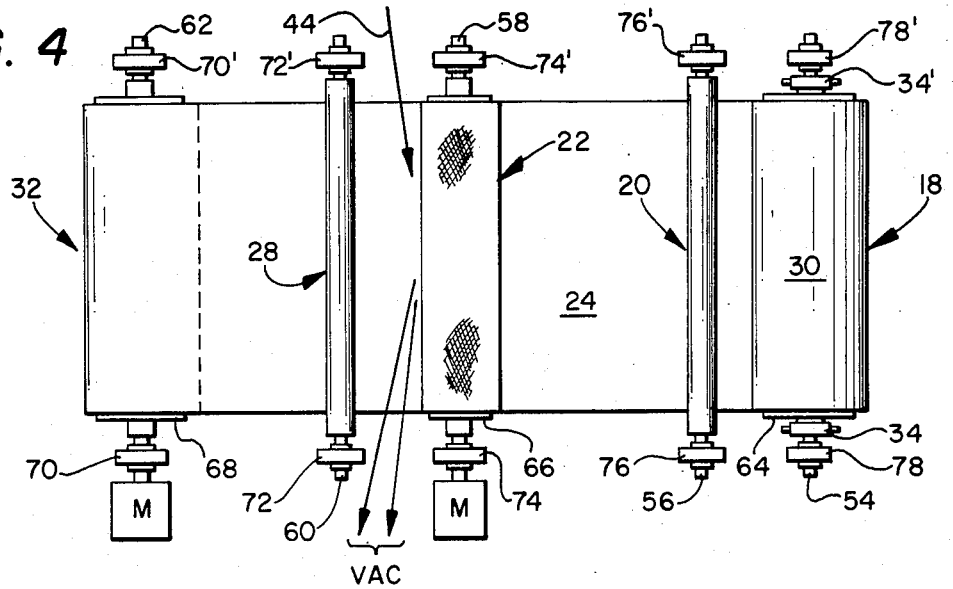
FIG. 4 is a top plan detailed view of the process disclosed in FIG. 3.

In FIGS. 1, 2, and 4, the take-up roller 32 at the processed station contains the processed web and is preferably provided with a similar drive train having a drive sprocket 40 rotated by a reduction gear assembly 42.

Figure 7:
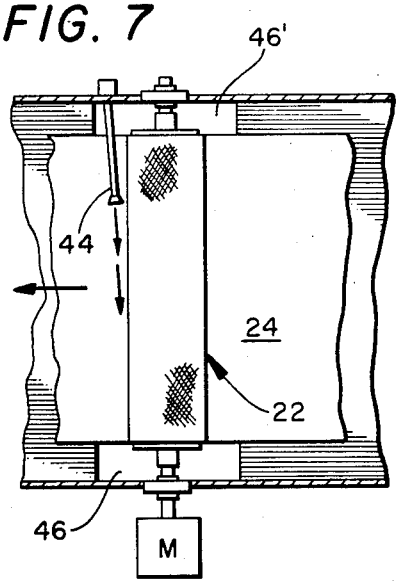
FIG. 7 is a fragmentary, top plan view of part of the apparatus disclosed in FIG. 1; and, FIG. 8 is a fragmentary side view showing additional details of the apparatus disclosed in FIG. 7.

Numeral 44 of FIGS. 1–4, 7 and 8 generally illustrates the location of an air jet 44. The air jet 44 is connected to a suitable source of compressed air so that a blast of air is directed laterally across the web and thereby moves any material in proximity of the web and roller so that the removed material is forced to flow towards the opposed traveling edge portions of the web and into one of the opposed vacuum ducts 46, 46'. The vacuum ducts 46 and 46' as seen in FIGS. 2 and 7, underlie the opposed marginal ends of the tabby roller, thereby translocating any loosened debris from the image side of the film to a point of disposal.

In FIG. 2, numeral 48 illustrates indicia which has been electrostatically affixed to the image side 24 of the web, and which is to be removed therefrom. In FIG. 1, numeral 50 indicates the entrance into the enclosure, while numeral 52 indicates the exit from the enclosure.

In FIGS. 1, 3, and 4, numerals 54–62, respectively, indicate a feed roller shaft, an idler roller shaft, a tabby roller shaft, another idler roller shaft, and a take-up roller shaft, respectively. Numerals 64–68, respectively, indicate a flange or boss located perpendicularly respective to the longitudinal axis of the before mentioned feed roller, cloth roller, and take-up roller, respectively.

Opposed bearings 70–78, respectively, rotatably support, in low friction relationship, members 32, 28, 22, 20, and 18, respectively.

In FIG. 1, numeral 80 indicates a sidewall which is arranged laterally respective to an end wall 82. Numeral 84 of FIG. 5 indicates a hydraulic motor having a control 86 for placing a constant torque on shaft 54, and hence a constant tension on the unrolled web. Numeral 88 indicates a drag device in the form of a hydraulic brake having a control 90 by which a constant drag is maintained on the processed or take-up roller 32.

In carrying out the method according to the present invention, the process comprehends rejuvenating used film in the form of an elongated plastic web member having an image side 24 opposed to a back side 30, wherein the means forming the indicia 48 on the image side must be carefully removed during the rejuvenation process. The web is arranged to move along its length from a loading station at feed roller 18 to a processed station at take-up roller 32. A marginal length of the image side of the web is engaged at spaced locations by the spaced guide means. The guide means are in the form of first and second idler rollers 20 and 28. The guide rollers are arranged perpendicularly respective to the longitudinal edges of the web. The guide rollers are positioned between the loading station 18 and the processed station 32.

A tabby roller in the form of a cylindrical wiping cloth is rotatably mounted within a housing and positioned perpendicular respective to the longitudinal web member. The tabby roller engages the image side of the web at a location between the spaced guide means. This arrangement of components urges the image side of the web to bear against the cylindrical cloth of the tabby roller, and when the web is moved along its length, the rotating cloth material engages and removes the indicia from the image side of the web, thereby restoring the web to a condition where it can be satisfactorily reused.

The loading station comprises a cylinder having opposed flanges 64 against which the brake device 34 adjustably engages so that the friction therebetween can be selected by adjusting the relative position thereof. The idlers 20 and 28 are positioned respective to the tabby roller so that the web is caused to bend about the outer peripheral surface area of the cloth material in the illustrated manner seen at 26 in FIG. 3.

In FIG. 1, the shaft 58 is driven by the sprocket 36 and motor driven gear reduction apparatus 38 in order to counter rotate the tabby roller. The shaft 62 is rotated by the sprocket 40 and motor driven reduction gear assembly 42 in order to cause the web to travel along its length.

The rolled up cylinders of used web material at 12 are sequentially moved into the inlet end 82 of apparatus 14 by sequentially mounting each of the cylinders onto the feed roller 18. The leading marginal end of the film is next roved under idler roller 20, under the tabby roller 22, under the second idler roller 28, and over the take-up roller 32. Take-up roller drive gear assembly 42 is actuated, thereby causing the web to be unrolled from the feed roller cylinder located at the loading station and rolled onto the take-up roller 32 which forms the processed station. The image side of the web is exposed on the processed cylinders 16.

Figure 8:
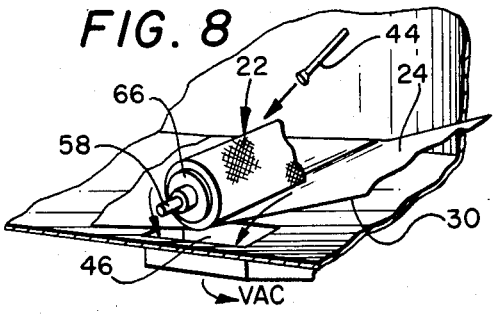

The air jet formed by the nozzle at 44 can be arranged in the illustrated manner of FIGS. 4, 7, and 8; or, alternatively, the air jet can be arranged with a plurality of nozzles so long as the air flow forces the removed image particles to travel toward the opposed ends of the tabby roller 22, where the suction ducts 46 and 46' ingest the air-borne particles and translocate the unwanted material to a suitable point of disposal.

Figure 5:
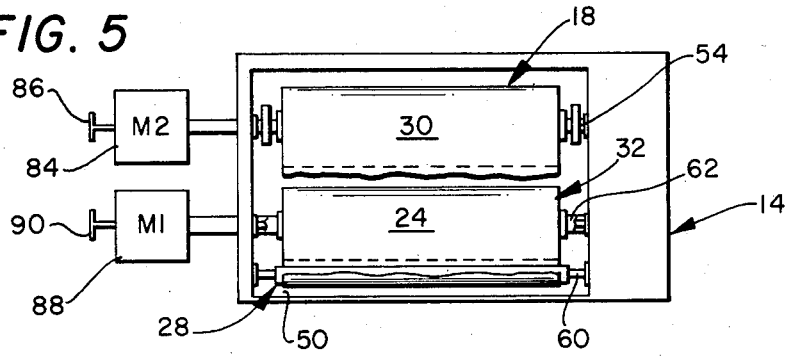
FIG. 5 is an opposed end view of an alternate form of the apparatus disclosed in FIG. 2.

As seen in FIG. 5, the feed roller 18 can alternatively be provided with a hydraulic motor or brake device 84 having adjustment 86 associated therewith in lieu of the illustrated friction brake seen at 34 in FIG. 1. The take-up roller 32 in FIG. 5 can be provided with a hydraulic motor 88 having adjustment 90 associated therewith for enabling the torque applied to the shaft 62 to be selectively adjusted. This arrangement of the motor and shaft, together with the relative, position of the idler and tabby roller, determines the magnitude of the force that the rotating cylindrical cloth exerts against the image side of the web. Moreover, the rotational speed of the take-up roller, together with the rotational speed of the tabby roller, determines the efficiency of operation. It is essential that the web contact and curve about at least part of the outer peripheral surface of the cylindrical cloth, as noted at 26. It is preferred that the web and outer surface of the cylindrical cloth tangentially meet one another along the edge portions thereof to form an included acute angle of at least 10°, and preferably less than 30°, as seen broadly illustrated by $\phi$ in FIG. 3.

In one specific example of the apparatus, made in accordance with the present invention, the loading station, first idler, cylindrical cloth, second idler, and take-up roller, respectively, were located along an X and Y axis as follows: 11, 8-½; 10, 2-½, 6, 2; 3-½; ½, 0, 2-½; inches, respectively.

The cylindrical cloth roller was driven 100 rpms by a 1/15th horsepower motor exerting 27 inch pounds, having a 52:1 ratio, and driving a 6 inch sprocket 36, which in turn drives a 1-½ inch sprocket at shaft 58. The roller attached to flange 66 is 3-½ inches in diameter with a special soft cloth rolled thereabout to increase the average diameter to 4 inches. The cloth is extended along the tabby roller a greater width as compared to the web width.

The feed drum and take-up drum each were 3-½ inches o.d., with there being about 5 inches o.d. when the rolled-up web is placed thereabout. Accordingly, in a direct drive system, the speed of the traveling web varies as the feed roller and the takeup roller change in effective diameters. Approximately 45 minutes was utilized in processing a 900 foot roll of web material.

The present apparatus enables the web to be reused 8–15 times as opposed to 3–5 times utilizing the prior art apparatus and process. Moreover, the present invention is less liable to cause creases and other imperfections in the web which usually renders the film worthless. Furthermore, the continued processing of the web by the present invention does not significantly shorten the overall length thereof because of the small amount of material at the leading and trailing ends that are lost as the film is processed by the apparatus.

One particular cloth material which has been found to work satisfactorily in carrying out the method of this invention is bleached tobacco cloth manufactured under U.S.P. This is a sterile woven cloth of the highest standards having 44×60 or 2024 threads per square inch and is available from the Kendall, Co., 20 Walnut Street, Wellesly, Mass.

The cloth can be made into a sock and forced to telescopingly slide onto the tabby roller. Alternatively, the cloth can be wound about the tabby roller. When the cloth surface of the tabby roller becomes dark with removed indicia, the cloth material can be removed or replaced thereon, thereby presenting a new, clean surface. This is conveniently achieved by removing a few turns or layers of the cloth from the tabby roller, and cutting the removed marginal length of material from the remaining cloth material.

I claim:

1. Process for rejuvenating a used roll of photosensitive film in the form of an elongate plastic web about one and one-half feet wide and several hundred feet long and having an image side opposed to a metallic back side, wherein means forming indicia on the image side must be removed without creasing the metallic back side during the rejuvenation process, comprising the steps of:

(1) arranging the web to move along its length from a roll located at a loading station to a roll located at a processed station;

(2) engaging a marginal length of the image side of the web at a location between the loading and the processed stations with guide means consisting essentially of only two spaced guide rollers;

(3) engaging a marginal length of the image side of the web at a location between said guide means with cleaning means consisting essentially of the outer surface of only one cylindrical wiping cloth;

(4) arranging the spaced guide rollers parallel to the cylindrical wiping cloth and laterally respective to the web;

(5) urging the image side of the web to bear against the outer periphery of the cylindrical wiping cloth by arranging the relative position of the longitudinal axis of the two spaced guide rollers and the longitudinal axis of the cylindrical wiping cloth whereby the image side of the web curves about a segment formed by the circumference of the cylindrical wiping cloth;

(6) rotating said cylindrical wiping cloth at a sufficient peripheral velocity to provide a wiping motion between the image side of the web and the outer surface of the wiping cloth;

(7) moving the web along its length so that the web travels from the loading to the processed stations;

(8) arranging the loading station roll, the cylindrical wiping cloth, the spaced guide rollers, and the processed station roll so that the length of the web between the loading and processed rolls enables removing the material which forms the indicia from the image side of the web without substantial loss of the usable image side of the web material;

(9) supplying a current of air adjacent to the contact area between the web and wiping cloth; and providing a suction means adjacent the edge portions of the web to thereby translocate the removed particles of the material forming the indicia to a location spaced from the web;

(10) whereby said web material, while traveling between the loading and the processed stations, is contacted only on the image side thereof, thereby avoiding damage to the metallic back side thereof.

2. Method of reclaiming used film of the electrostatic type which is in the form of an elongate plastic web several hundred feet in length and more than one foot in width, said web having an image side upon which indicia has been placed, said image side is opposed to a metallic back side, wherein material forming indicia on the image side must be removed without damaging the metallic backing material, comprising the steps of:

(1) arranging the web to move along its length from a loading station to a processed station by rolling the opposed marginal lengths of the web onto spaced cylinders;

(2) placing one cylinder at said loading station and the other cylinder at the processed station and in a location to receive the processed film;

(3) engaging a marginal length of the image side of the web at a location between the loading and the processed stations with guide means consisting essentially of two spaced guide rollers;

(4) providing a cylindrical wiping cloth consisting essentially of a cylinder having multiple layers of cloth material wound about the exterior of the cylinder;

(5) locating said spaced guide rollers respective to said cylindrical wiping cloth to cause the image side of the film to engage at least 10° of the circumference of the cylindrical wiping cloth;

(6) arranging the axis of said guide rollers and said cylindrical wiping cloth to extend laterally respective to the web and parallel respective to one another;

(7) carrying out step (5) by urging the image side of the web to bear against the cylindrical wiping cloth by arranging the longitudinal axis of the guide means respective to the longitudinal axis of the cylindrical wiping cloth to cause the web to curve about a segment formed by the outer surface of the cylindrical wiping cloth;

(8) moving the web along its length so that the web travels from the loading to the processed stations while a marginal length of only the image side of the web simultaneously bears against the guide means and the cylindrical wiping cloth;

(9) rotating the cylindrical wiping cloth about the longitudinal axis thereof while carrying out step (8)

to engage any material forming indicia with the outer peripheral surface of the cylindrical wiping cloth with sufficient force to cause said cylindrical wiping cloth to remove said indicia from said image side of said web without damage to the image side of the web and thereby cleaning all of the usable image side of the film length;

and (10) carrying out step (7) by increasing the film tension by means of a drag brake device located at the loading station.

3. Apparatus for removing electrostatically deposited means forming indicia from the image side of a web of used film, wherein the film is an elongated web several hundred feet long and more than a foot wide, and has a metallic back side opposed to the image side; comprising:

only one feed roller upon which the used web of film can be mounted for rotation;

only one take-up roller upon which a length of processed web of film can be mounted for rotation;

means for wiping indicia from the image surface of the web consisting essentially of only one cylindrical wiping cloth mounted for rotation; guide means consisting of essentially only two spaced guide rollers;

means mounting said guide rollers fore and aft of said cylindrical wiping cloth respective to the direction of travel of the web of film; said cylindrical wiping cloth has an outer cloth surface of a gauze-like texture which wipingly engages the image side of the web and thereby removes the means forming indicia therefrom;

means for rotating said take-up roller, said feed roller includes brake means by which the tension of the web can be adjusted to thereby increase the wiping force of the cylindrical wiping cloth against the image side of the film;

said feed roller, take-up roller, cylindrical wiping cloth, and spaced guide rollers all having an axial centerline arranged parallel respective to one another;

means mounting said guide rollers and said cylindrical wiping cloth whereby the axis thereof are arranged respective to one another to cause the image side of the web to contact and bear against several degrees of curvature of the outer circumferential surface area of the cylindrical wiping cloth;

means mounting said guide rollers respective to said cylindrical wiping cloth, said feed roller, and said take-up roller whereby the web can be moved from said feed roller, across one guide roller, circumferentially about part of the outer peripheral surface area of said cylindrical wiping cloth, about the other guide roller, and about said take-up roller; with the image side of the web being urged against the cylindrical wiping cloth with sufficient force to be wipingly engaged by the outer surface thereof; the relative position of said guide rollers, said cylindrical wiping cloth, said feed roller, and said take-up roller is arranged respective to one another whereby all of the usable image side of the film is cleaned of said means forming indicia;

the cloth of said cylindrical wiping cloth is cylindrical in overall configuration and the cloth is placed in sufficient quantity about the outer surface of the cylindrical wiping cloth to form a multiplicity of cloth layers so that the outermost layer of cloth can deformably engage the image side of the web and gently wipe the indicia therefrom without injury to the image side of the web; and, means are provided for rotating said cylindrical wiping cloth and said take-up roller at a speed to cause the outermost layer of said cylindrical wiping cloth to wipingly engage the means forming indicia with a sufficient wiping action to cause the

* * * * *

UNITED STATES PATENT AND TRADEMARK OFFICE

CERTIFICATE OF CORRECTION

PATENT NO. : 4,657,598

DATED : April 14, 1987

INVENTOR(S) : KENDELL L. GREEN

It is certified that error appears in the above-identified patent and that said Letters Patent is hereby corrected as shown below:

Column 2, line 54, substitute --of-- for "or", first occurrence;

Column 10, line 38, insert --indicia to be removed therefrom.-- after "the".

Signed and Sealed this

Tenth Day of November, 1987

*Attest:*

DONALD J. QUIGG

*Attesting Officer*

*Commissioner of Patents and Trademarks*